United States Patent [19]

Barras

[11] Patent Number: 4,826,241

[45] **Date of Patent: * May 2, 1989**

[54] FOLDING CHAIR

[76] Inventor: Lee J. Barras, P.O. Box 1711, Gretna, La. 70054-1711

[ * ] Notice: The portion of the term of this patent subsequent to Jan. 5, 2005 has been disclaimed.

[21] Appl. No.: 141,481

[22] Filed: Jan. 5, 1988

Related U.S. Application Data

[63] Continuation-in-part of Ser. No. 818,213, Jan. 13, 1986, Pat. No. 4,717,201.

[51] Int. Cl.[4] ..... A47C 4/00

[52] U.S. Cl. ..... 297/16; 297/45; 297/183

[58] Field of Search ..... 297/16, 17, 35, 39, 297/45, 46, 42, 183

[56] References Cited

U.S. PATENT DOCUMENTS

| | | | |
|---|---|---|---|
| 1,808,201 | 5/1931 | Bauer | 297/39 |
| 2,104,255 | 1/1938 | Garbaccio | 297/45 |
| 2,192,672 | 3/1940 | Connor, Jr. | 297/35 |
| 2,638,970 | 5/1953 | Harber | 297/39 |
| 2,820,509 | 1/1958 | Moreland | 297/183 |
| 4,065,173 | 12/1977 | Gittings | 297/45 |
| 4,652,047 | 3/1987 | Chan | 297/45 |
| 4,717,201 | 1/1988 | Barras | 297/16 |

FOREIGN PATENT DOCUMENTS

| | | | |
|---|---|---|---|
| 1112257 | 11/1955 | France | 297/45 |
| 5806 | of 1909 | United Kingdom | 297/45 |

*Primary Examiner*—Francis K. Zugel

*Attorney, Agent, or Firm*—Pravel, Gambrell, Hewitt, Kimball & Krieger

[57] ABSTRACT

A folding chair comprises left and right A-frames which are connected by fore and aft jointed cross braces. Each A-frame comprises two legs which are pivotally connected at their upper ends. The cross braces are pivotally attached to the legs of the A-frames at the lower end of the braces, and connected to the legs at the upper end of the cross braces with short links forming the upper joint of the cross brace strut. The seat and back of the chair are pivotally connected to one another. The chair folds into a bundle having a length substantially equal to that of the legs of the A-frames.

12 Claims, 2 Drawing Sheets

FOLDING CHAIR

REFERENCE TO RELATED APPLICATION

This is a continuation-in-part of U.S. Ser. No. 6/818,213, filed Jan. 13, 1986, by Lee J. Barras entitled "Folding Chair" now U.S. Pat. No. 4,717,201.

BACKGROUND OF THE INVENTION

1. Field of the Invention

This invention relates to portable, collapsible furniture such as might be used for camping, sports events, or furnishing in casual areas of the home. More particularly, the folding chair relates to hinged frame chairs with foldable fabric webs which fold to compact size for storage and transport.

2. General Background

Folding chairs are used in a wide variety of applications whenever seating must be compacted for transport or storage and erected for use in different locations. Folding chairs have proven useful for such activities as camping, viewing parades, and extra seating abut the home. Portable folding chairs allow persons of advanced age or those with medical infirmities greater mobility and enjoyment in attending activities away from home simply because personal seating is available when desired.

Many types of folding chairs have been developed in the past but have proven to be less than satisfactory due to their uncomfortable nature when erect. Many chairs have small seat or back surfaces which make sitting for even short periods uncomfortable. Often seat and back surfaces of folding chairs are perched upon small base frames which place the occupant in peril of capsize with even the slightest movement. Folding chairs are also difficult to erect or collapse without considerable awkward time consuming effort by one or more persons. Folding chairs which manage to overcome these disadvantages usually fold into unusual shapes which are difficult to transport or store due to their size or loose dangling components. The geometric configuration of a number of folding chairs also fails to allow the use of materials of sufficient size and shape to prevent even slight overloading, unavoidable misuse, or wear from severly damaging the folding or seating characteristics of the chair.

For example, U.S. Pat. No. 1,977,766 teaches the use of a single standard to support the seat and back of the chair. This allows for an awkward seating position due to the manner in which the back must be positioned over the seat. The single standard design further requires that the folded chair be of considerable length for storage and of unstable geometric design.

The Arnold U.S. Pat. No. 2,871,921, entitled "Collapsible Folding Chair," shows a director-type chair having a fabric-type seat having A-frame-type side portions. The French Patent No. 1,112,257 shows a chair having four cross brace frames. Other patents which show generally chair constructions include the Bauer U.S. Pat. No. 1,808,201; the Harber U.S. Pat. No. 2,638,970; the Moreland U.S. Pat. No. 2,820,509; the Crandall U.S. Pat. No. 398,943; the Dryden U.S. Pat. No. 3,000,667; the Watkins U.S. Pat. No. 4,118,065; the Roher et al. U.S. Pat. No. 3,635,520; the Connor U.S. Pat. No. 2,192,672; the McQuilkin U.S. Pat. No. 2,713,385; and the Lorenz U.S. Pat. No. 2,894,564.

The above paragraph lists patents which were cited during the prosecution of the parent application of this application, U.S. Ser. No. 818,213, filed Jan. 13, 1986, and now U.S. Pat. No. 4,717,201, issued Jan. 5, 1988.

SUMMARY OF THE INVENTION

The folding chair of the invention solves the aforementioned problems by a unique hinged A-frame structure with a seat and back attached to the A-frame. The structure provides a spacious, comfortable seat and back positioned between the A-frames so that the A-frames provide an arm rest and enhanced stability. The seat rotates about the A-frame to provide substantially compact storage within the length of the A-frames. Once the seat is rotated on the A-frames the chair may be folded simply by lifting a strap connected to cross bracing between the A-frames. The cross bracing features two longer braces connected near a central point. Each cross brace is a two-part strut having a smaller upper portion which folds to shorten the overall brace when the chair folds. During folding, the cross braces pivot and collapse into linear alignment with each A-frame which also collapses into linear alignment. The geometric configuration of the chair allows the strength of materials in each member of the seat, cross bracing and A-frames to be used to optimum advantage. This leads to further stability of the chair in the erected position, greater endurance, greater resistance to overloading, and decreased weight.

Collapsible webbing between the A-frames prevents the legs of the A-frames from spreading beyond a certain distance during erection and use of the chair. Members supporting collapsible material of the seat connect to the A-frame on each side when the seat is erected so that the web of the seat will support the weight of a person and retain its erect shape.

The manner in which the A-frames, cross bracing, and seat combine provide a chair which is more stable, more easily collapsible, more easily portable, and of a greater strength to weight ratio than to other folding chairs.

The present invention provides an improved folding chair having a locking arrangement which rigidly affixes the cross bracing of the chair when the seat portion of the chair is folded into an operative sitting position. An improved construction allows a camber or inclination to be incorporated into the legs of the chair so that heavier loads can be carried.

BRIEF DESCRIPTION OF THE DRAWINGS

A better understanding of the invention can be obtained when the detailed description of the preferred embodiment set forth below is considered in conjunction with the following drawings, in which.

Figure 1:
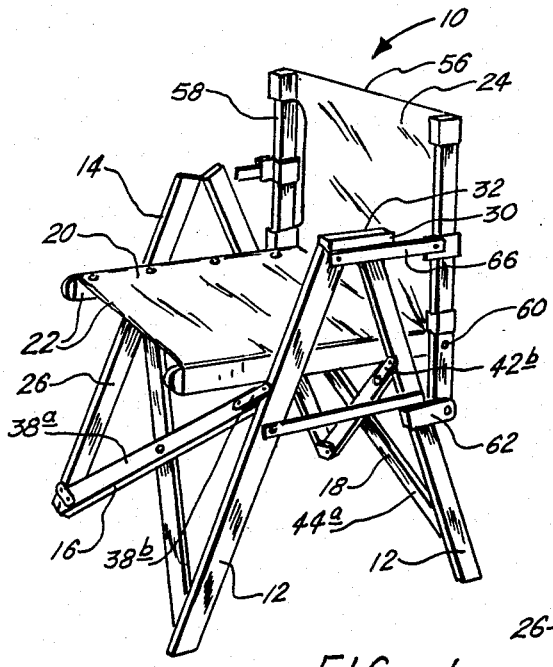
FIG. 1 is a perspective view of the folding chair in the erect position.
Figure 2:
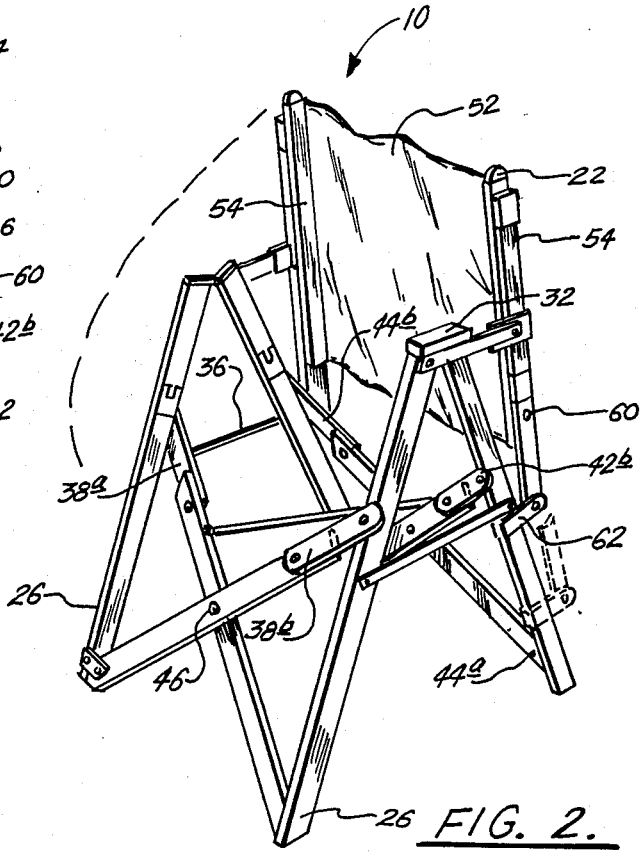
FIG. 2 is a perspective view of the folding chair illustrating the manner in which the seat and back pivot on the A-frame as the chair is folded.

DESCRIPTION OF THE PREFERRED EMBODIMENT:

FIGS. 1–3 and 5–6 generally depicts the folding chair 10 of the instant invention. Folding chair 10 has a left 12 and right 14 A-frame which are held apart in the erected position by front 16 and rear 18 cross braces. A surface 20 for sitting and the like is made of a seat 22 and back 24 which are pivotally connected to the A-frame 12, 14. In the preferred embodiment the pivotal connection at the crown of each A-frame 12, 14, forms an arm rest 30. For purposes of illustration, the arm rest 30 is only shown on the A-frame 12. Each A-frame 12, 14 has an arm rest 30.

Figure 3:
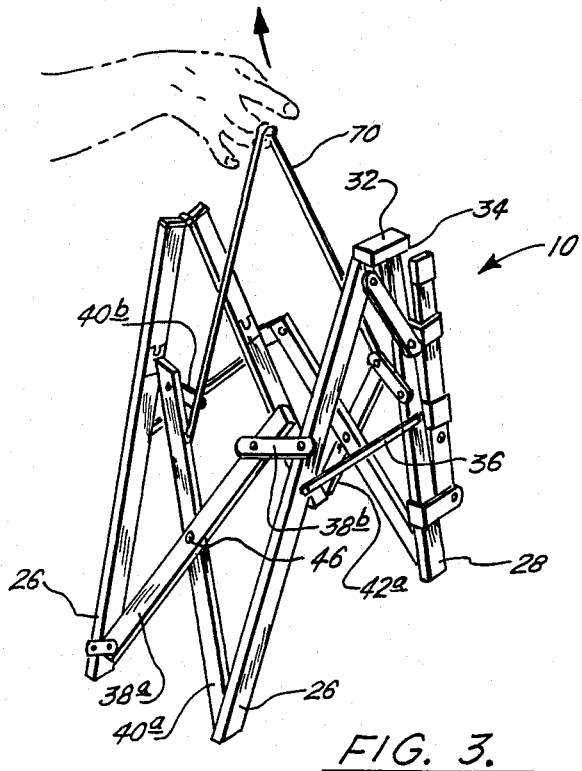
FIG. 3 illustrates the manner in which the cross bracing and A-frames fold.

Each arm rest 30 has a top surface 32 made of wood or other materials comfortable for use as an arm rest. As illustrated in FIG. 3, a flange 34 protrudes from the bottom of the upper surface 32 to which the front 26 and rear 28 leg of each A-frame 12, 14 is pivotally attached. The A-frames 12, 14 and arm rests may be attached to the flange 34 by common means such as threaded nuts and bolts. Webbing 36 is connected between the front 26 and rear 28 leg of each A-frame 12, 14 at a preferred position below seat 22. Webbing 36 is a foldable, flexible, generally inextensible material which can be attached to the front leg 26 and rear leg 28 by appropriate means known in the art.

The front cross brace 16, comprises a first strut member 38 and second strut member 40. The rear cross member 18 comprises a first strut member 42 an second strut member 44. The strut members 38, 40, off front 16 cross brace are pivotally connected near their mid-portions at a pinned connection by suitable means such as a nut and bolt at pivotal connection 46. The lower end of first member 38 is pivotally connected to the lower end of the front leg 26 of left A-frame 12. Similarly, the lower end **40*a* of second strut member 40 of front cross brace 16 is pivotally connected to the lower end of the front leg 26 of right A-frame 14. Likewise, the lower end 42*a* of first strut member 42 is pivotally connected to the lower end of left A-frame 12, and the lower end 44*a* of second strut member 44 of rear cross brace 18 is pivotally connected to the lower end of the rear leg 28 of right A-frame 14**.

The upper strut ends **38*b*, 42*b*, 40*b*, 44*b* are links forming a connection between the A-frames 12, 14 and the legs generally opposite the lower strut ends 38*a*, 40*a*, 42*a*, 44*a***.

Seat 22 is comprised of foldable material 52 affixed to spaced apart seat frame members 54. Back 24 is composed of foldable material 56 affixed to two back frame members 58. The seat frame members 54 are pivotally joined to the back frame members 58 by suitable means such as pin 60. Pin 60 places the pivot point of the seat 22 to the rear of the A-frames 12, 14. Back frame members 58 are connected pivotally at the bottom to the rear A-frame legs 28 by using lower back sleeve 62. Lower back sleeve 62 can easily slide up and down A-frame leg 28, and is attached to leg 28 by appropriate means known in the art. The back frame members 58 are also connected pivotally to the front A-frame legs 26 by using back sleeve 64. The upper back sleeve can easily slide up and down the back frame member 58. The pivotal connection between upper back sleeves 64 and the front A-frame legs 26 at the front fastener of brace 34. Members 58 align with the rear A-frame members 28 when the seat 22 and back 24 slide down along the A-frame members 28 so the chair may be fully collapsed. Also the elongated bar 66 serves as a supportive member when the chair is erected in keeping the back frame members 58 from moving inward or backward when pressure is applied to the back 24.

Figure 4:
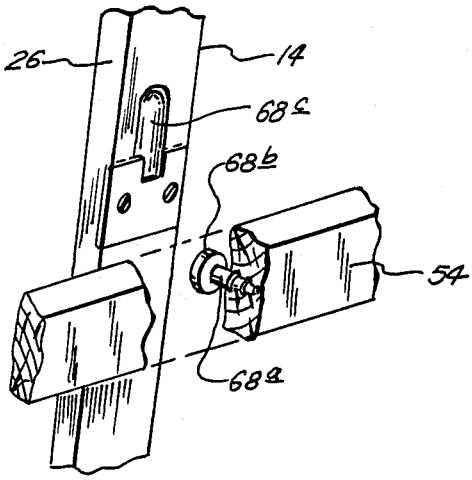
FIG. 4 is a fragmentary, perspective view which illustrates the catch between the seat frame members and the legs of the frame.
Figure 7:
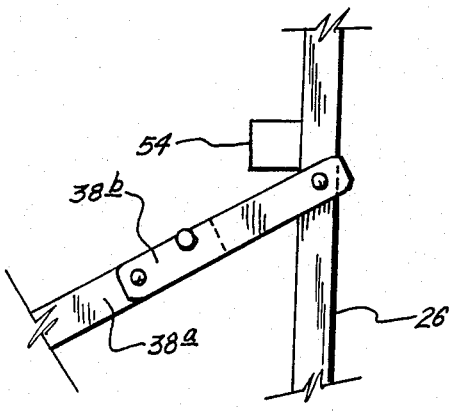
FIG. 7 is a fragmentary view of the preferred embodiment of the apparatus of the present invention illustrating the cross brace strut in a locked position.
Figure 8:
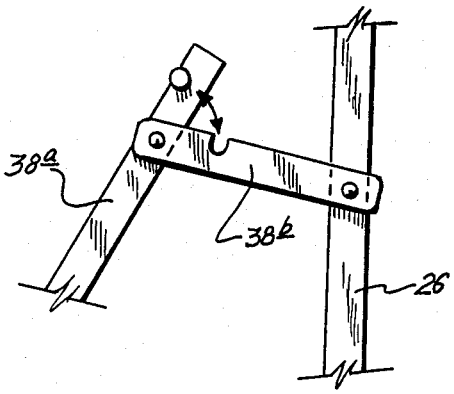
FIG. 8 is a fragmentary view of the preferred embodiment of the apparatus of the present invention in a collapsed-unlocked position.

Each of the seat support frame members 54 also have a catch 68 which allows each seat frame member to be attached to the front leg 26 and the rear leg 28 of the A-frame proximate to each seat support frame member 54. FIG. 4 more clearly illustrates lock-catch 68 comprising a large head bolt **68*a*. The bolt 68*a* is placed on the seat frame member 54 such that its head 68*b* will fit into and engage a slot 68*c* in lock 68. A portion of the leg 26 is recessed behind the sleeve-lock 48 in order to accommodate the screw head 68*b*. The catches 68 retain seat support frame members 54 in a position near the left 12 and right 14 A-frame when weight is applied to seat 22 and allow seat 22 to be released so that it will rotate on pin 60 to the storage position. The seat members 54 lock the upper strut members 38*b*, 40*b*, 42*b*, 44*b* in an operative position as shown in FIG. 7 so that the upper and lower strut portions are generally aligned. In FIG. 8, a inoperative position is shown as the strut portions 38*a*, 38*b* are being folded. Struts 40, 42, 44 similarly fold as the strut 38 illustrated in FIG. 8**.

The rotational alignment of seat frame members 54, back frame members 58, and arm rest 32 should be noted. Arm rest 32 prevents rotation of back support frame members 58 toward the crown of the left 12 and right 14 A-frames once the back 56 reaches a generally vertical and upright position. The distance between seat frame members 54 is narrower than the width between the left 12 and 14 A-frames. Seat support members 54 are free to rotate past the crown of left 12 and right 14 A-frames to a horizontal position so that they can be locked by catches 68 on the front legs 26 and rear leg 28 of the A-frames 12, 14.

Figure 5:
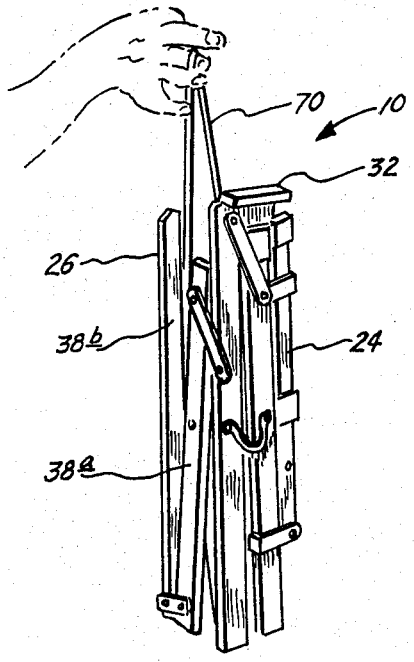
FIG. 5 is a perspective view which illustrates the preferred embodiment of the apparatus of the present invention in the folded position.
Figure 6:
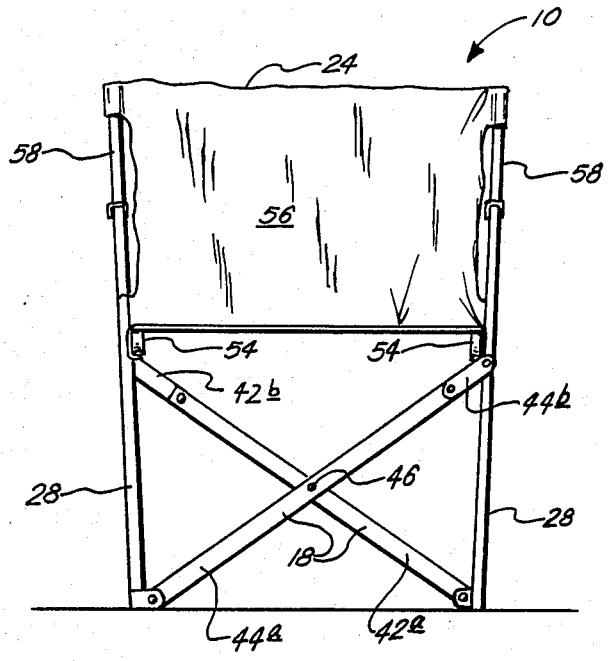
FIG. 6 is a rear view of the preferred embodiment of the apparatus of the present invention.

In order to fold the chair from the erect position illustrated in FIG. 1 to the compact position illustrated in FIGS. 3 and 5 one initially releases the seat support frame members 54 upwardly and rotates the seat support frame clockwise as illustrated in FIG. 3. The seat 22 and back 24 as a unit will then slide down the rear A-frame legs 28 to the storage position as illustrated in FIG. 5. The struts 38, 40, 42, 44 are then folded as shown in FIGS. 3 and 8. Note that the length of seat support frame members 54 and back support frame members 58, and cross bracing members 38, 40, 42, 44 is such that in the storage or folded position they do not extend in length beyond the legs 26, 28 of the A-frames 12, 14 for compact storage. The cross brace struts 38, 40, 42, 44 do not need to be as long as the legs 26, 28, so that the chair 10 can be more compact and more stable. The chair seat width can be greater as compared to the length of the legs and a camber or inclination can be imparted to the legs (FIG. 6).

A flexible handle 70, extends between opposite members of the front 16 and rear 18 cross braces. As illustrated in FIG. 3, flexible handle 70 extends between the upper portion of the second cross member 40 and the upper portion of the first strut cross member 42, but may extend between members 38 and 44. Lifting the flexible handle 70 vertically causes the front 16 and rear 18 cross members to collapse while drawing the left 12 and right 14 A-frames together, and further drawing the front 26 and rear 28 legs of the A-frame together. When collapsed, the folding chair assumes the position illustrated in FIG. 5.

In order to erect the chair from the collapsed position of FIG. 5 an operator need merely grasp the handles 32 and separate the left 12 and right 14 A-frames the maximum width allowed by the front 16 and rear 18 cross braces and the flexible fabric of seat 22 and back 24. The operator then spreads the front legs 26 and rear legs 28 of the A-frames 12, 14 to the extent allowed by A-frame webbing 36. Finally, the operator lifts the seat 22 and back 24 into the position of FIG. 1, such that back frame members 58 press against arm rest 32 and seat support frame members 54 lock in the upper strut portions 38*b*, 40*b*, 42*b*, 44*b* (See FIG. 7.)

The folding chair as illustrated is composed of wood and fabric materials, and connected by nuts and bolts. However, the foregoing disclosure and description of the invention are illustrative and explanatory, and various changes in size, shape and materials, as well as in the details of the illustrated method of folding and erecting the chair, and details of construction, may be made without departing from the spirit of the invention. All such changes and variations are contemplated as falling within the scope of the appended claims.

What is claimed as invention is:

1. A folding chair which can be collapsed for storage and erected to provide seating the like comprising:

(a) left and right frames, each comprising front and rear legs which are connected together at their upper level portions with a pivot connection, and a pair of spaced-apart fore and aft extending seat support members;

(b) tensile means for defining the degree of rotation of each leg about the pivot connection;

(c) fore and aft, folding cross braces, each forming connections respectively between the front legs of each side frame and the rear legs of each side frame and including cross brace jointed struts that can fold upon each other and simultaneously shorten so that said cross bracing means and side frames can simultaneously fold together with a bundle defining a folded position which generally aligns both legs of each side frame and both cross braces of each cross brace;

(d) handle means attached at spaced positions when unfolded to the fore and aft cross bracing respectively for folding the cross bracing and the side frames into the "folded" storage position, (e) a seat, supported by the pair of seat support members of the side frames; and (f) means for locking the jointed cross braces into an operative position when the chair is in use, the seat including foldable material that allows the seat support members to align when the chair is folded.

2. The folding chair of claim 2 in frames are A-frames and the pivotal connection of the A-frames form arm rests for the occupant of the seat.

3. The folding chair of claim 3 further comprising a folding back connected to the seat.

4. The folding chair of claim 4 in which the a seat and back are pivotally attached to the A-frames at a common pivot point respectively on the sides of the seat and back.

5. The folding chair of claim 1 in which the cross braces are pivotally attached to the side frames at each end so that as the chair folds the upper ends of the cross braces move linearly into proximate co-extensible linear relation with the legs of the side frames.

6. The folding chair of claim 1 in which the seat is connected to the front and rear legs of the left and right side frame at a point below the pivotal connection of the side frames and above the front and rear cross braces.

7. The folding chair of claim 1 in which the seat and back are pivotally connected to the rear leg of each side e frame and removably connected to the front leg of each side frame.

8. Folding chair of claim 1 in which the seat and back each comprise foldable material connected between left and right rigid support members which are connected respectively to the left and right side frames.

9. The folding chair of claim 1 in which an inextensible brace extends between a rigid member of the frame and a rigid member of the back to prevent the back from pivoting when the chair is in the erect position.

10. The folding chair of claim 1 wherein the folding cross braces camber the left and right frames with respect to each other.

11. A folding chair comprising:

a. left and right side A-frames, each comprising front and rear legs which are substantially equal in length and which are connected together at their upper end portions with a pivotal connection;

b. collapsing brace means associated with each side frame for supporting the legs in an unfolded operative position;

c. fore and aft, folding cross braces, each forming connections respectively between the front legs of each side frame and the rear legs of each side frame, the cross braces being pivotally attached to the side frames at the lower end of the cross braces and the cross braces further including upper link members pivotally affixed to the side frames and forming a connection between the upper end of the cross braces and the side frames so that as the chair can fold the cross braces and legs align;

d. a seat supported at left and right edge portions upon the side frames when the chair is in an unfolded operative sitting position, the seat being connected to the front and rear legs of the left and right side frames at a point below the pivotal connection of the side frames and above the front and rear cross braces;

e. a back pivotally attached at its side portions to the rear of the seat;

f. sleeve means forming a sliding connection between the bottom edge portions of the back and each rear leg for retaining the lower side portions of the back in two separate, spaced apart positions with respect to the rear legs, including a higher position when the chair is in the unfolded operation position and a lower position near the bottom of the rear legs when the chair is in a folded inoperative storage position; and g. link means connecting the side frames and back for preventing the back from pivoting rearwardly when the chair is in the unfolded operative sitting position, wherein:

the seat nd back include foldable fabric material, the legs, back, and seat can collapse into a bundle wherein the legs, cross braces, seat edges, and back side portions are generally aligned parallel to one another, and the bundle has a length substantially equal to the length of the legs.

12. The folding chair of claim 11, wherein the pivotal connection of the A-frames include arm rests for an occupant of the seat.

* * * * *